US006554919B2

(12) United States Patent
Bano et al.

(10) Patent No.: US 6,554,919 B2
(45) Date of Patent: Apr. 29, 2003

(54) HOT-ROLLED STEEL WITH VERY HIGH ELASTICITY LIMIT AND MECHANICAL RESISTANCE USABLE IN PARTICULAR FOR AUTO PARTS PRODUCTION

(75) Inventors: Xavier Bano, Istres (FR); Jacques Devroc, Arles (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/819,630

(22) Filed: Mar. 29, 2001

(65) Prior Publication Data

US 2001/0049956 A1 Dec. 13, 2001

(30) Foreign Application Priority Data

Mar. 29, 2000 (FR) ..... 00 03958

(51) Int. Cl.[7] ..... C22C 38/24; C21D 8/02
(52) U.S. Cl. ..... 148/334; 148/654
(58) Field of Search ..... 148/334, 654, 148/593; 420/111

(56) References Cited

U.S. PATENT DOCUMENTS 5,919,415 A 7/1999 Pichard

FOREIGN PATENT DOCUMENTS

| | | |
|---|---|---|
| EP | A 0 761 824 | 3/1997 |
| FR | A 197 19 546 | 1/1998 |
| FR | A 197 10 125 | 9/1998 |
| WO | WO 99/02747 | 1/1999 |
| WO | WO 99/05328 | 2/1999 |

*Primary Examiner*—Deborah Yee
(74) *Attorney, Agent, or Firm*—Sughrue Mion, PLLC

(57) ABSTRACT

Hot-rolled steel with very high elasticity limit and mechanical resistance usable in particular for auto parts production, characterized by the following composition by weight:
0.08%<carbon<0.16%
1%<manganese<2%
0.02%<aluminum<0.1%
silicon<0.5%
phosphorus<0.03%
sulfur<0.01%
vanadium<0.3%
chromium<1%
nitrogen<0.015%
molybdenum<0.6%.

7 Claims, 2 Drawing Sheets

HOT-ROLLED STEEL WITH VERY HIGH ELASTICITY LIMIT AND MECHANICAL RESISTANCE USABLE IN PARTICULAR FOR AUTO PARTS PRODUCTION

The invention relates to a hot-rolled steel with very high elasticity limit and mechanical resistance usable in particular for auto parts production.

In the field of hot-rolled steel sheet production, a steel whose characteristics are obtained by controlled rolling, products with high elasticity limits is known, i.e., 315 MPa to 700 MPa.

In the field of hot-rolled metal sheets produced from a strip train, the operating performance of parts obtained by molding from these sheets is an important criterion because it defines the useful life of the molded parts, for example, by stamping, profiling or hydroforming.

Operating performance in connection with performance with fatigue defines the useful life for specific charges.

To improve the fatigue resistance of molded parts, one solution consists of using very high-resistance steels with considerable fatigue resistance properties, because at first glance, there is a proportional relationship between maximum endurance and mechanical resistance. Nevertheless, the steel must be able to be stamped. In general, molding properties decrease as mechanical resistance increases, thereby limiting the molding possibilities for parts able to be manufactured from high-resistance steel.

Shock-resistance is also an important characteristic for reasons of safety, namely in automobile applications, since shock-resistance defines the resistance to sudden breakage of the parts. To improve this characteristic of molded parts, a solution consists of using very high-resistance steels with considerable fatigue resistance properties, because at first glance, there is a linear relationship between shock-resistance and maximum elasticity. However, molding properties generally decrease as maximum elasticity increases.

In the range of common flat hot-rolled products, the mechanical characteristics of which are obtained by controlled rolling on a wide-strip train, in particular there are four primary categories of steel with superior mechanical characteristics.

HLE steels with high maximum elasticity are micro-alloy steels with maximum elasticity ranging from 315 MPa to 700 MPa, but having limited moldability in particular because of a high Re/Rm ratio greater than 0.85. These steels have a carbureted ferrite-phase structure of the cementite kinds. The elasticity maximum is obtained by controlled rolling and precipitation of the micro-alloying elements such as niobium, vanadium and titanium during ferrite transformation.

Dual-phase steels are steels with a ferrite martensite structure with noteworthy molding properties. Mechanical resistance levels generally range from 550 MPa to 800 MPa. The highest level is obtained by precipitation of micro-alloying elements during the ferrite transformation that completes the hardening effect of martensite.

HR steels are steels referred to as high-resistance, with carbon and manganese and undergoing relatively rapid cooling after rolling, along with low-temperature coiling, to give them a ferrite-baintic structure. Their intermediate moldability level is between that HLE steels and that of dual-phase steels. Resistance levels range from 450 MPa to 800 MPa.

Martensite steels have the highest resistance levels. These steels have a martensite structure obtained by heat treatment after rolling. It is difficult to produce this kind of structure on a wide-strip train because of the fragility of martensite, which causes the strip to break after rolling. Martensite steels make it possible to achieve resistance levels above 1,000 MPa but with very low ductility levels and expansions of less than 8%. In addition, a heat treatment must be carried out after rolling.

Increasing the resistance level of all of the above-mentioned steels entails an increase in rolling efforts, thereby limiting the reduction in thickness and not allowing the full benefits of alloying.

The goal of the invention is to present a hot-rolled steel with very high maximum elasticity mechanical resistance and good molding characteristics to produce parts by stamping, profiling and hydroforming, namely for the auto industry.

The object of the invention is a hot-rolled steel with very high maximum elasticity and mechanical resistance usable in particular for producing auto parts, characterized by the following composition by weight:

0.08%<carbon<0.2%
1%<manganese<2%
0.02%<aluminum<0.1%
silicon<0.5%
phosphorus<0.03%
sulfur<0.01%
vanadium<0.3%
chromium<1%
nitrogen<0.015%
molybdenum<0.6%
the rest being of steel and impurities inherent in processing.

The steel is preferably characterized by the following composition by weight:

0.1%<carbon<0.14%
1.4%<manganese<1.8%
0.02%<aluminum<0.08%
0.15%<silicon<0.3%
phosphorus<0.03%
sulfur<0.008%
0.1%<vanadium<0.3%
0.3%<chromium<0.6% nitrogen<0.012%
0.15<molybdenum<0.4
the rest being of iron and impurities inherent in processing. The invention also relates to a process for producing a hot-rolled steel sheet strip with very high resistance usable in particular to produce auto parts and characterized in that the steel has the following composition by weight:

0.08%<carbon<0.2%
1%<manganese<2%
0.02%<aluminum<0.1%
silicon<0.5%
phosphorus<0.03%
sulfur<0.01%
vanadium<0.3%
chromium<1%
nitrogen<0.015%
molybdenum<0.6%
the rest being of iron and impurities inherent in processing is subjected to:

rolling at a temperature below 950° C. and preferably below 880° C., cooling carried out at a rate of more than 20° C. per second and preferably at a rate ranging from 100° C. to 200° C. per second up to a temperature ranging from 400° C. to 600° C., and preferably up to a temperature ranging from 450° C. to 500° C.

The following description and the attached figures, all provided as non-limitative examples, will make the invention well understood.

The steel according to the invention, with the following composition by weight:

0.08%<carbon<0.2%

1%<manganese<2%

0.02%<aluminum<0.1% silicon<0.5% phosphorus<0.03% sulfur<0.01% vanadium<0.3% chromium<1% nitrogen<0.015% molybdenum<0.6% the rest being of iron and impurities inherent in processing, has an entirely bainite structure. In this form, resistance levels of greater than 1,000 MPa with expansions exceeding 10% can be attained.

The steel molded from a hot-rolled strip according to the invention is subjected to:

rolling at a temperature below 950° C. and preferably below 880° C., cooling carried out at a rate of more than 20° C. per second and preferably at a rate ranging from 100° C. to 200° C. per second up to a temperature of 400° C. to 600° C., preferably up to a temperature of 450° C. to 500° C.

Figure 1:
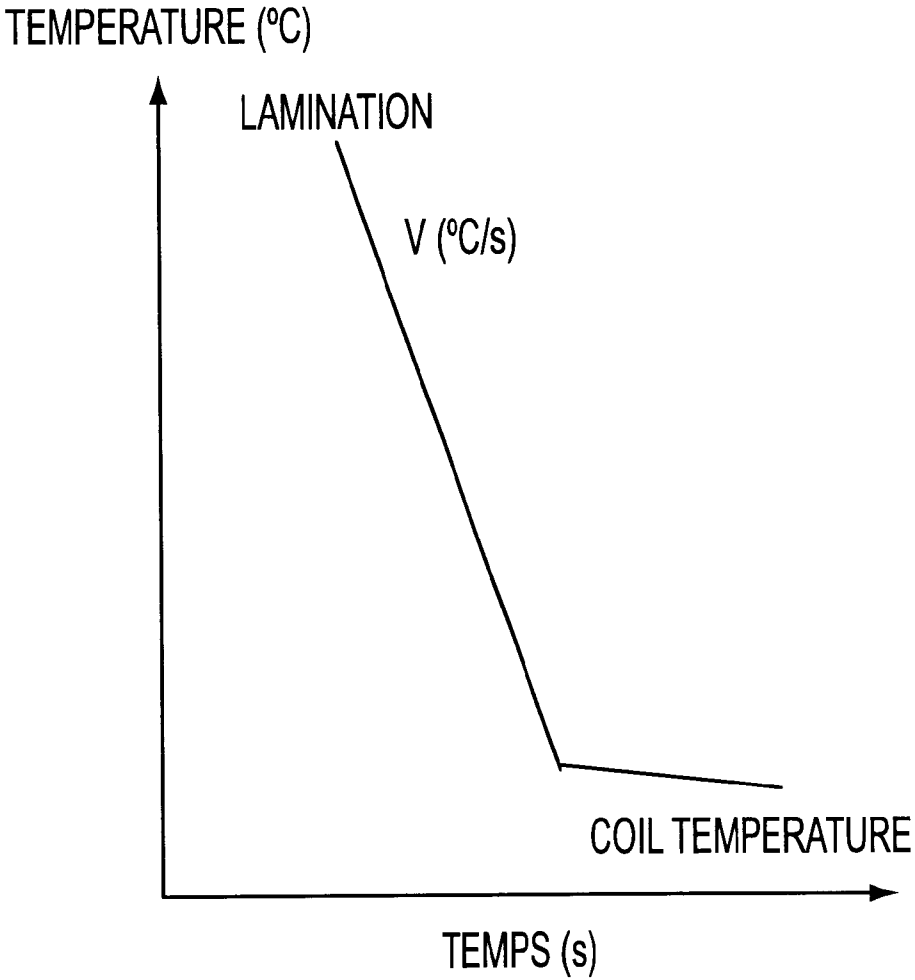
FIG. 1 is a schematic illustration showing the temperature change as a function of time during cooling of the hot-rolled steel strip.

As shown in the diagram of FIG. 1, the cooling cycle, starting from a temperature of 400° C. to 600° C., preferably up to a temperature of 450° C. to 500° C., is carried out on coil.

From the perspective of the composition of the steel according to the invention:

carbon limited to 0.2% ensures good welding while allowing hardening by precipitation with the vanadium.

manganese makes it possible to lower the transformation points AR3, Bs and Ms corresponding to the starting temperature for ferrite transformation, the starting temperature for bainite transformation, and the starting temperature for martensite transformation, respectively. With this effect, it enables hardenability to be increased while avoiding the forming of ferrite due to the high cooling speeds and to obtain an entirely bainite structure. The lowered start of bainite transformation allows the mechanical properties to be increased.

aluminum is used to calm the steel down.

silicon is kept at relatively low levels to benefit from the hardenability in solid solution it provides without degrading the surface condition after pickling, or the product's ability to be coated on a continuous galvanizing or electro-zincing line. Silicon is known to degrade the surface appearance of pickled products by forming $Fe_2O_3SiO_4$ on the one hand, and on the other hand, degrading wettability and thus clinging to clothes.

molybdenum, due to its hardening effect, namely a reduction of Bs, enables the mechanical properties to be increased by forming a fully bainite structure.

vanadium is the element needed to form precipitate of nitride and carbide type, which form at different temperatures during the course of the heat treatment. These very hardening precipitates allow to obtain the very high level of mechanical properties This element makes this hardening possible by precipitation without increasing hardness when hot. This effect runs contrary to the known effects of micro-alloying elements which, by precipitation induced during rolling, cause an increase in said hardness when hot. This finding enabled the inventors, with the element vanadium contained in the steel according to the invention, to roll thin sheets down to 1.4 mm thick without increasing the rolling efforts.

The examples below show the results obtained for an example B applied according to the invention and supported by two comparative examples, A and C, one comprising a low vanadium level and the other with a high level of vanadium.

The compositions of the examples are shown in table 1 below:

TABLE I

| Steel | C | Mn | Cr | Mo | Si | N | V | P |
|---|---|---|---|---|---|---|---|---|
| A | 0.11 | 1.58 | 0.51 | 0.33 | 0.2 | 0.0035 | 0 | 0.02 |
| B | 0.11 | 1.58 | 0.51 | 0.32 | 0.2 | 0.0040 | 0.2 | 0.02 |
| C | 0.11 | 1.58 | 0.51 | 0.34 | 0.2 | 0.0050 | 0.45 | 0.02 |

Table 2 below provides the conditions for heat treatment after hot rolling.

TABLE 2

| Steel | Rolling temperature ° C. | Cooling temperature ° C./s | Coiling temperature ° C. |
|---|---|---|---|
| A | 900 | 65 | 450 |
| B | 885 | 40 | 450 |
| C | 890 | 50 | 450 |

Table 3 below shows the mechanical characteristics in mechanical resistance Rm, maximum elasticity Re, and expansion A, of the three forms of construction.

TABLE 3

| Steel | Rm (MPa) | Re (MPa) | A (%) |
|---|---|---|---|
| A | 790 | 670 | 14 |
| B | 1,090 | 990 | 10.4 |
| C | 1,125 | 1,015 | 8.9 |

It can be seen that the vanadium increases mechanical resistance and reduces expansion. Vanadium is the necessary element in steel with a bainite structure in order to produce a hardening effect, something that was not expected since the micro-alloying elements have a hardening effect by precipitation but this precipitation ends at a higher temperature and must be carried out in the ferrite domicile in order to be hardening. This effect cannot be obtained by other micro-alloying elements such as titanium or niobium because these elements cause an increase in hardness when hot, thus limiting the hot-rolling reduction rates and thus the minimum thickness achievable for this kind of sheet metal. It turns out that vanadium has no effect on hardness when hot.

Other residual elements may be present and used according to their known properties such as Cu and Ni. Added alloying elements such as titanium or boron can be used to promote the precipitation of vanadium carbides at the expense of vanadium nitrides. Titanium and boron form nitrides at high temperature, which remain stable during the subsequent heat treatment.

Industrial experiments were conducted based on analysis B presented in table No. 4.

TABLE NO. 4

| C % | Mn % | Cr % | N % | V % | Mo % | Al % | Si % |
|---|---|---|---|---|---|---|---|
| 0.124 | 1.560 | 0.389 | 0.0051 | 0.189 | 0.280 | 0.031 | 0.185 |

Figure 2:
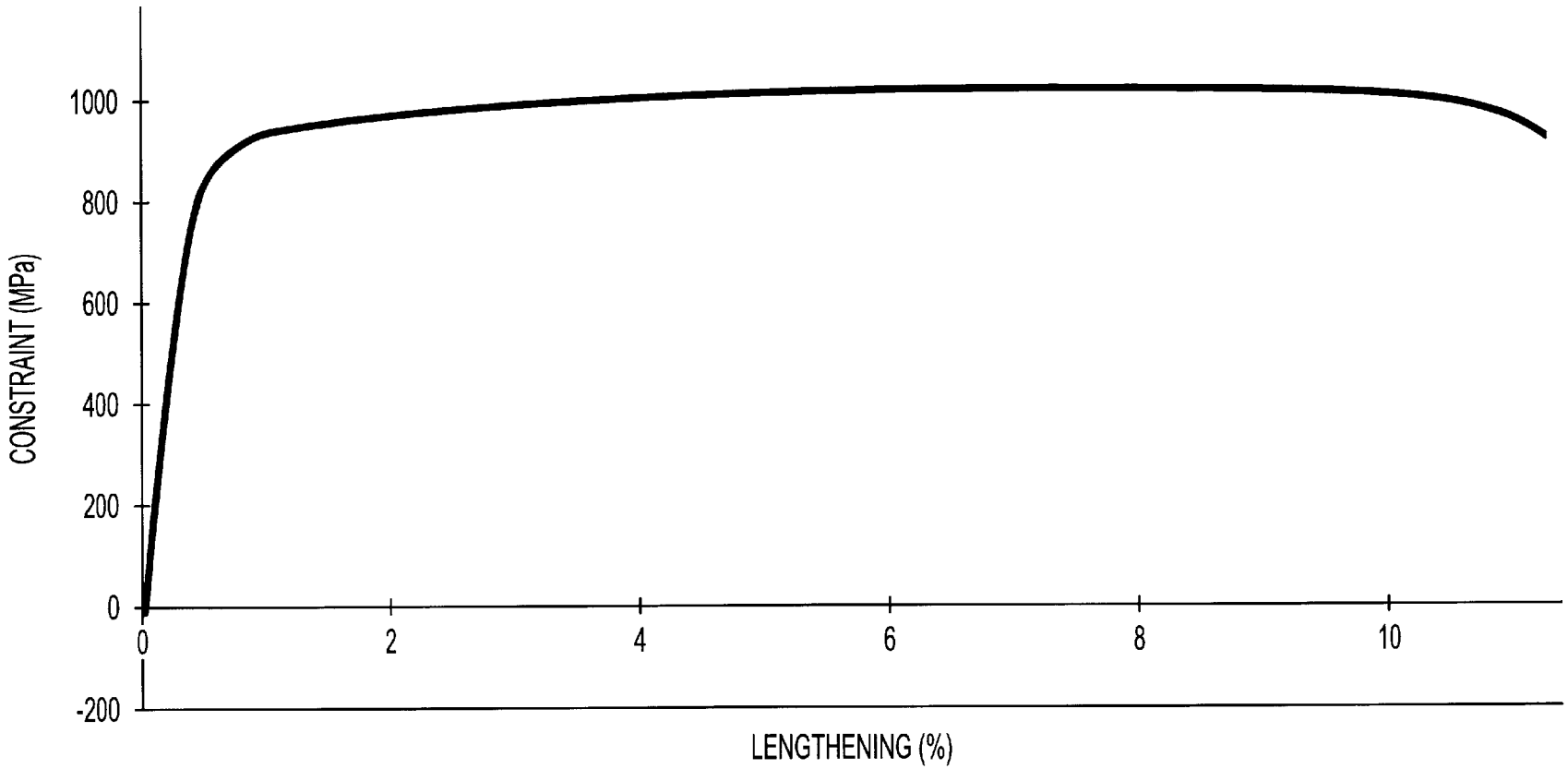
FIG. 2 shows an expansion curve as a function of constraint for steel according to the invention.

An example of mechanical property obtained for a thickness of 1.7 mm is shown in FIG. 2 by means of a traction curve.

The characteristics of the steel are 1,015 MPa mechanical resistance, 880 MPa maximum elasticity and 12% expansion.

The final structure of the steel according to the invention is a bainite structure. This structure makes it possible to achieve maximum elasticity greater than 700 MPa, mechanical resistance greater than 1,000 MPa and expansion greater than 10%. These values show the good molding properties of the steel according to the invention.

The invention makes it possible to roll a steel 1.4 to 5 mm thick with high mechanical resistance, i.e., above 1,000 MP, as well as noteworthy molding characteristics, thanks to an expansion of more than 10%.

The flawless surface condition after pickling of the hot-rolled steel is ensured by a silicon content in the steel's composition of less than 0.5%.

The hot-rolled steel sheet strip of the invention is advantageous in its use in sectors of activity such as the auto industry and mechanical construction in general, for stamped, folded, profiled or hydroformed parts, which can be expanded while ensuring fatigue resistance, improved shock resistance and a combination of these advantages.

What is claimed is:

1. A hot-rolled steel with very high maximum elasticity and mechanical resistance usable in particular for producing auto parts, said steel comprising an entirely bainitic structure and the following composition by weight:

0.08%<carbon<0.2%

1%<manganese<2%

0.02%<aluminum<0.1% silicon<0.5% phosphorus<0.03% sulfur<0.01%

0.1%<vanadium<0.3% chromium<1% nitrogen<0.015% molybdenum<0.6% the rest being of steel and impurities inherent in processing, wherein said steel does not comprise niobium.

2. Steel according to claim 1, characterized by the following composition by weight:

0.1%<carbon<0.14%

1.4%<manganese<1.8%

0.02%<aluminum<0.08%

0.15%<silicon<0.3% phosphorus<0.03% sulfur<0.008%

0.1%<vanadium<0.3%

0.3%<chromium<0.6% nitrogen<0.012%

0.15<molybdenum<0.4 the rest being of iron and impurities inherent in processing.

3. A process for producing a hot-rolled steel sheet strip with very high resistance usable to produce auto parts, wherein the steel comprises an entirely bainitic structure and the following composition by weight:

0.08%<carbon<0.16%

1%<manganese<2%

0.02%<aluminum<0.1% silicon<0.5% phosphorus<0.03% sulfur<0.01%

0.1%<vanadium<0.3% chromium<1% nitrogen<0.015% molybdenum<0.6% the rest being of iron and impurities inherent in processing, wherein the steel does not comprise niobium and is subjected to:

rolling at a temperature below 950° C., cooling carried out at a rate of more than 20° C. per second up to a temperature ranging from 400° C. to 600° C.

4. The process of claim 3, wherein cooling is carried out at a rate ranging from 100° C. to 200° C. per second up to a temperature ranging from 400° C. to 600° C.

5. The process of claim 3, wherein cooling is carried out at a rate of more than 20° C. per second up to a temperature ranging from 450° C. to 500° C.

6. The process of claim 3, wherein cooling is carried out at a rate ranging from 100° C. to 200° C. per second up to a temperature ranging from 450° C. to 500° C.

7. The process of claim 3, wherein rolling is carried out at a temperature below 880° C.

* * * * *